US008265505B2

(12) United States Patent
Mills, III et al.

(10) Patent No.: US 8,265,505 B2
(45) Date of Patent: Sep. 11, 2012

(54) SELECTIVE COOLING OF A FUSER HEATER ROLLER

(75) Inventors: Borden H. Mills, III, Webster, NY (US); Edward M. Eck, Lima, NY (US); Anne F. Lairmore, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 121 days.

(21) Appl. No.: 12/702,343

(22) Filed: Feb. 9, 2010

(65) Prior Publication Data

US 2011/0194867 A1 Aug. 11, 2011

(51) Int. Cl.
*G03G 15/20* (2006.01)

(52) U.S. Cl. ..... 399/69; 399/334

(58) Field of Classification Search ..... 399/67, 399/69, 324, 328, 330, 334, 348
See application file for complete search history.

(56) References Cited

U.S. PATENT DOCUMENTS

| | | | | |
|---|---|---|---|---|
| 3,936,658 | A | 2/1976 | Traister et al. | |
| 4,963,943 | A | 10/1990 | Tamary | |
| 5,406,362 | A | 4/1995 | Mills | |
| 5,991,565 | A | 11/1999 | Hanyu et al. | |
| 6,289,185 | B1 | 9/2001 | Cahill | |
| 6,532,348 | B2 | 3/2003 | Allmendinger | |
| 7,054,572 | B2 * | 5/2006 | Baruch et al. | 399/69 |
| 7,570,894 | B2 * | 8/2009 | Kostyk et al. | 399/45 |
| 2007/0166084 | A1 | 7/2007 | Yoshino et al. | |
| 2008/0267651 | A1 | 10/2008 | Gruszczynski et al. | |

FOREIGN PATENT DOCUMENTS

| | | | |
|---|---|---|---|
| JP | 2007 328161 | A | 12/2007 |
| WO | WO 2005/024526 | A1 | 3/2005 |

* cited by examiner

*Primary Examiner* — Hoang Ngo
(74) *Attorney, Agent, or Firm* — Donna P. Suchy

(57) ABSTRACT

A controlled fuser assembly for a reproduction apparatus. The fuser assembly includes a fuser member for fusing a marking particle image to a receiver member and a cooling system for controlling the temperature of the fuser system. Optional external heater rollers have a heat transfer surface adapted to be selectively engaged with the fuser member, and a device for heating said heat transfer surfaces. A mechanism is provided for controlling the heat transfer with the fuser member to selectively change the amount of heat transferred from the fuser.

23 Claims, 4 Drawing Sheets

SELECTIVE COOLING OF A FUSER HEATER ROLLER

CROSS REFERENCE TO RELATED APPLICATIONS

This application relates to commonly assigned, copending U.S. application Ser. No. 12/702,348, filed 9 Feb. 2010, entitled: "SELECTIVE COOLING OF A FUSER" hereby incorporated by reference.

FIELD OF THE INVENTION

This invention relates in general to a fuser assembly for an electrographic reproduction apparatus, and more particularly to a fuser assembly including a cooling system for effectively cooling the fuser to regulate the fuser temperature.

BACKGROUND OF THE INVENTION

Wrinkles and image defects are unwanted side effects often encountered in the use of a heated roller fuser in an electrophotographic printer (EP). In typical commercial reproduction apparatus (electrostatographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly for typical electrographic reproduction apparatus includes at least one heated roller, having an aluminum core and an elastomeric cover layer, and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member and then is permanently fixed to the receiver member.

Wrinkles and image defects can be caused by differential overdrive in the fuser nip. Overdrive is caused by deflection of the incompressible elastomer on either or both the fuser roller and pressure roller when the fusing nip is formed and the rollers are rotated. Differences in elastomeric deflection along the axes of the fuser and pressure roller cause corresponding differences in differential overdrive and thus substrate velocity, which in turn cause wrinkles or image defects. Specifically, when the center of the substrate is driven faster than the edges, the trail edge of the substrate will collapse and form wrinkles as the substrate passes through the fuser nip. When the edges of the substrate are driven faster than the center, the trail edge of the substrate will "slap" up or down and smear the image as the image is fused.

Several methods are used to prevent wrinkles and image defects. One common method is to vary the diameter of the fuser or pressure roller along the roller length to reduce the nominal amount of differential overdrive in the nip. Another method is taught in U.S. Pat. No. 5,406,362, where the force that forms the fuser nip is applied inside the ends of one of the rollers in order to impart a bending moment to one of the rollers which in part counteracts the deflection of the fuser and pressure rollers as the nip forming force is applied.

The problem of differential overdrive and resulting wrinkles and image defects is further complicated by temperature differences along the fuser and pressure roller axis, which in turn cause differences in overdrive due to thermal expansion of the elastomer on at least one of the rollers. In addition, the amount of thermal expansion increases during a print run, as heat is continually applied by the fuser lamp(s) to the rollers. Differential thermal expansion is further varied by the width of the substrate. Narrower substrates, as the substrate passes though the fuser nip, causes the ends of the rollers to increase in temperature and thus thermal expansion, since no heat is removed by the substrate outside its path through the fuser nip. The increased thermal expansion of the ends of the roller(s) increases overdrive on the edges of the paper, causing image defects as described.

Another method of improving axial temperature uniformity in a roller fuser is taught in U.S. Pat. No. 6,289,185, where multiple lamps having different filament lengths are used compensate for differences in substrate width. Still another method is taught in U.S. Pat. No. 7,054,572, where the middle of a fuser roller is cooled prior to a print run, to simulate the removal of heat by the substrates, so that axial roller temperatures and resulting differential overdrive is reduced during a subsequent print run.

These methods are not sufficient to prevent all wrinkles and image defects under all conditions, including changes in ambient relative humidity. These problems are especially evident in certain circumstances, such as when heater rollers having thick walls are used to externally heat the fuser roller because the roller transfers heat so well along the axis of the rollers that lamps of different filament length have only a minimal effect on the temperature differential along the fuser roller. Further problems arise due to a lack of access to the middle of the fuser roller because of the placement of other components such as oilers, skives, temperature sensors and cleaners that are necessary for fuser operation.

This controlled fuser system and related method solves these problems by using strategically placed and controlled fluid directed on one of a fuser roller and/or heater rollers such that one or more fusing parameter controls the system, such as cooling air directed at the ends of these rollers based on a receiver sheet width.

SUMMARY OF THE INVENTION

The present invention is in the field of electrophotographic printers and copiers. More specifically this invention relates to a temperature controlled fuser apparatus used to fuse an image on a receiving sheet. The apparatus may include a fuser having a run condition and an idle condition, the fuser having a fuser roller, a fuser roller heater, and a fuser temperature sensor which inputs to a logic and control system which controls the heating of the fuser roller heaters. The fuser roller may be cooled during or after the idle condition, prior to the first receiving sheet entering the fuser. The fuser roller has end portions and a middle portion, and the middle portion may be cooled relative to said end portions. Additional aspects and representative embodiments are described herein.

DETAILED DESCRIPTION OF THE INVENTION

Figure 1:
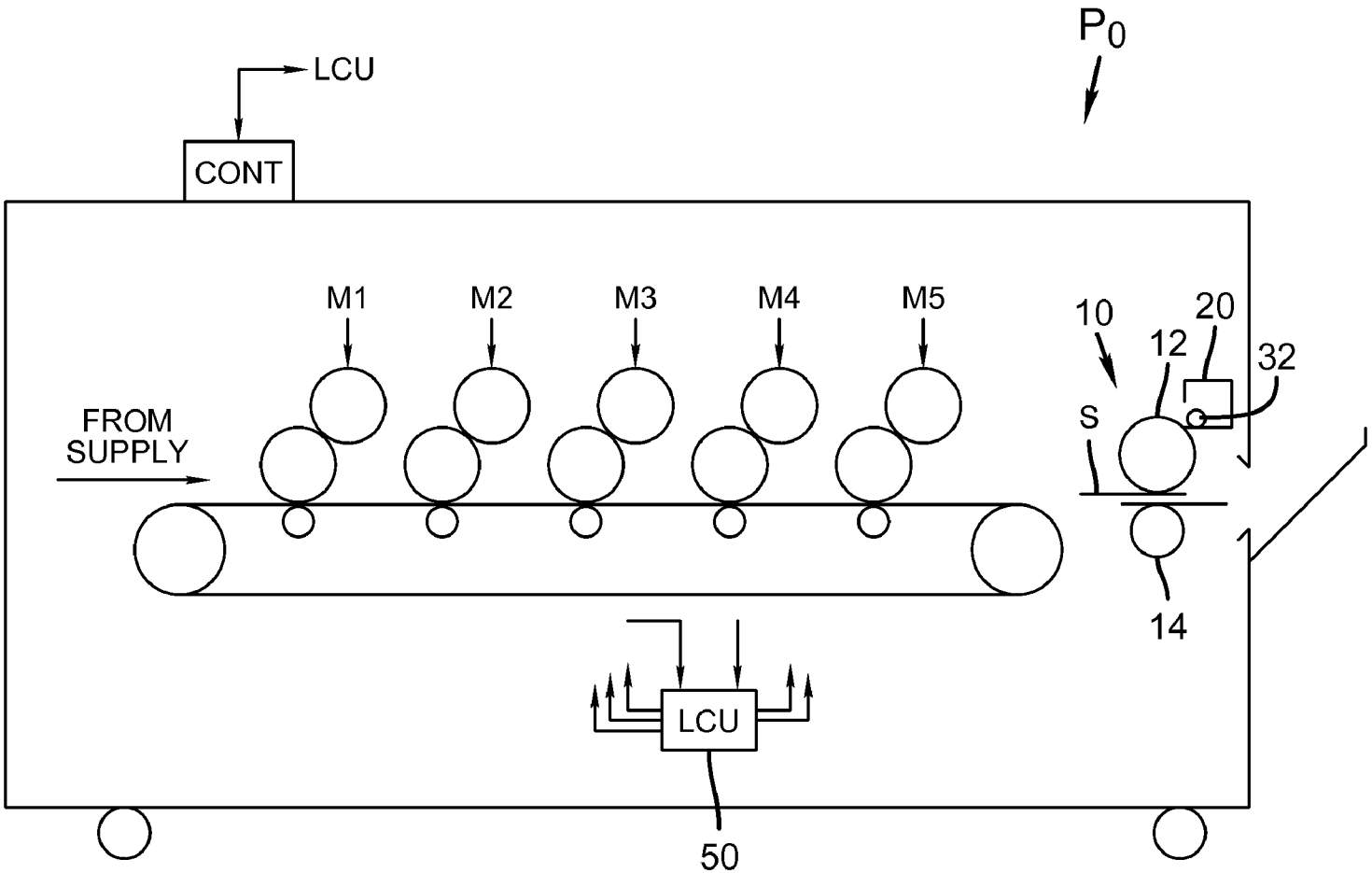
FIG. 1 is a schematic diagram illustrating an electrographic printing module for use with the present invention.

Referring now to the accompanying drawings, FIG. 1 schematically illustrates an electrographic printer engine according to embodiments of the current invention. Although the illustrated embodiment of the invention involves an electrographic apparatus employing five image producing print modules arranged therein for printing onto individual receiver members, the invention can be employed with either fewer or more than five modules. The invention may be practiced with other types of electrographic modules.

The electrographic printer engine P has a series of electrographic printing modules M1, M2, M3, M4, and M5. As discussed below, each of the printing modules forms an electrostatic image, employs a developer having a carrier and toner particles to develop the electrostatic image, and transfers a developed image to a receiver member S. Where the toner particles of the developer are pigmented, the toner particles are also referred to as "marking particles." The receiver member may be a sheet of paper, cardboard, plastic, or other material to which it is desired to print an image or a predefined pattern. In one embodiment of the invention (not shown) a fusing module is interspaced between at least two of the printing modules.

The electrographic printing modules M(1-5) shown in FIG. 1 each include a plurality of electrophotographic imaging subsystems for producing one or more multilayered image or shape. Included in each printing module is a primary charging subsystem for uniformly electrostatically charging a surface of a photoconductive imaging member (shown in the form of an imaging cylinder. An exposure subsystem is provided for image-wise modulating the uniform electrostatic charge by exposing the photoconductive imaging member to form a latent electrostatic multi-layer (separation) image of the respective layers. A development station subsystem is provided developing the image-wise exposed photoconductive imaging member. An intermediate transfer member is provided for transferring the respective layer (separation) image from the photoconductive imaging member through a first transfer nip to the surface of the intermediate transfer member and from the intermediate transfer member through a second transfer nip to a receiver member S.

Figure 2:
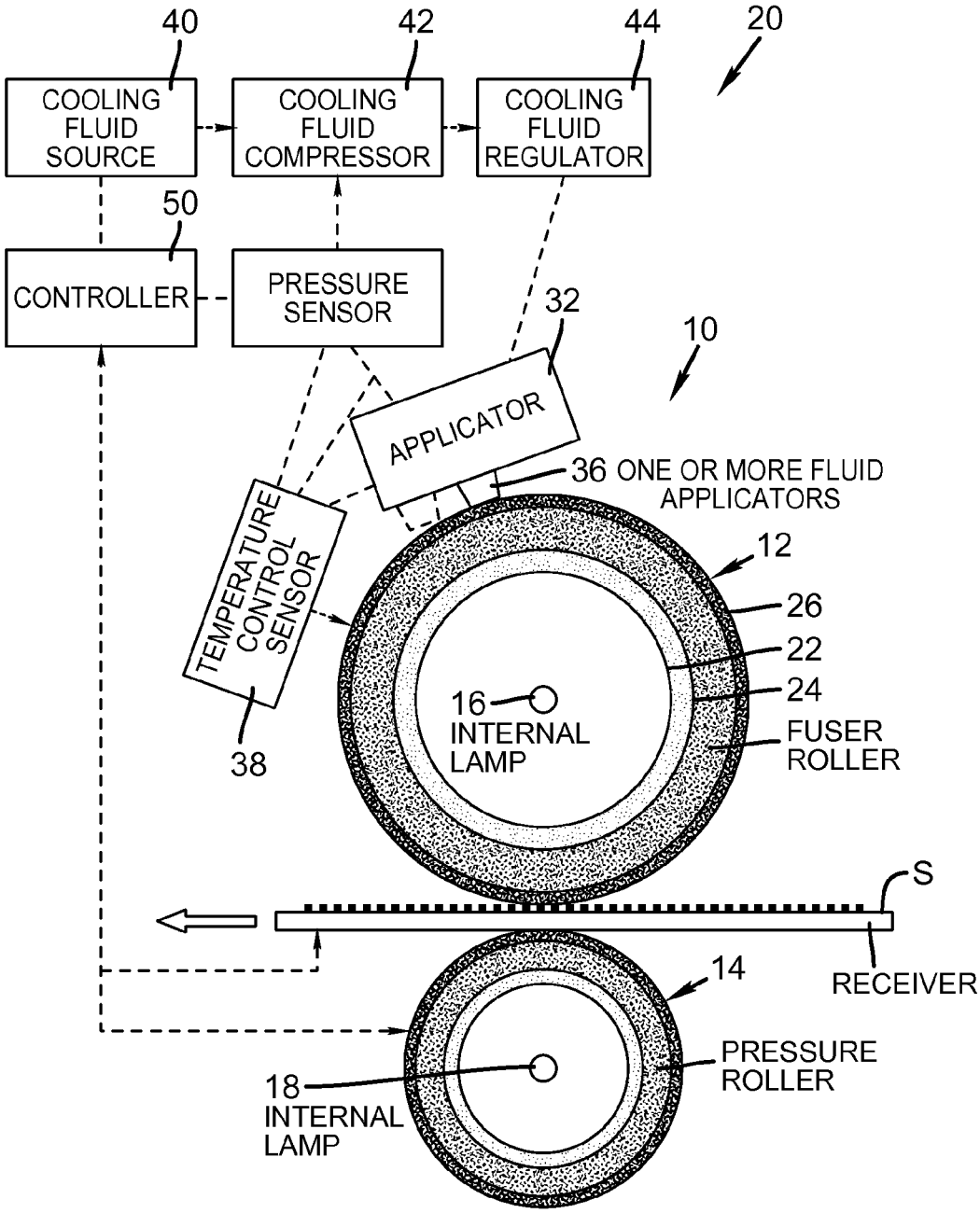
FIG. 2 presents a schematic diagram of an electrographic marking or reproduction system in accordance with the present invention.

FIG. 2 shows a roller fuser assembly 10 including a temperature controlled fuser system including a cooling system to work in conjunction with the printing device. As discussed above the printing device exposes the primary imaging member to create an electrostatic latent image, and has one or more development stations capable of converting the electrostatic latent image into an image on a receiver.

Figure 3:
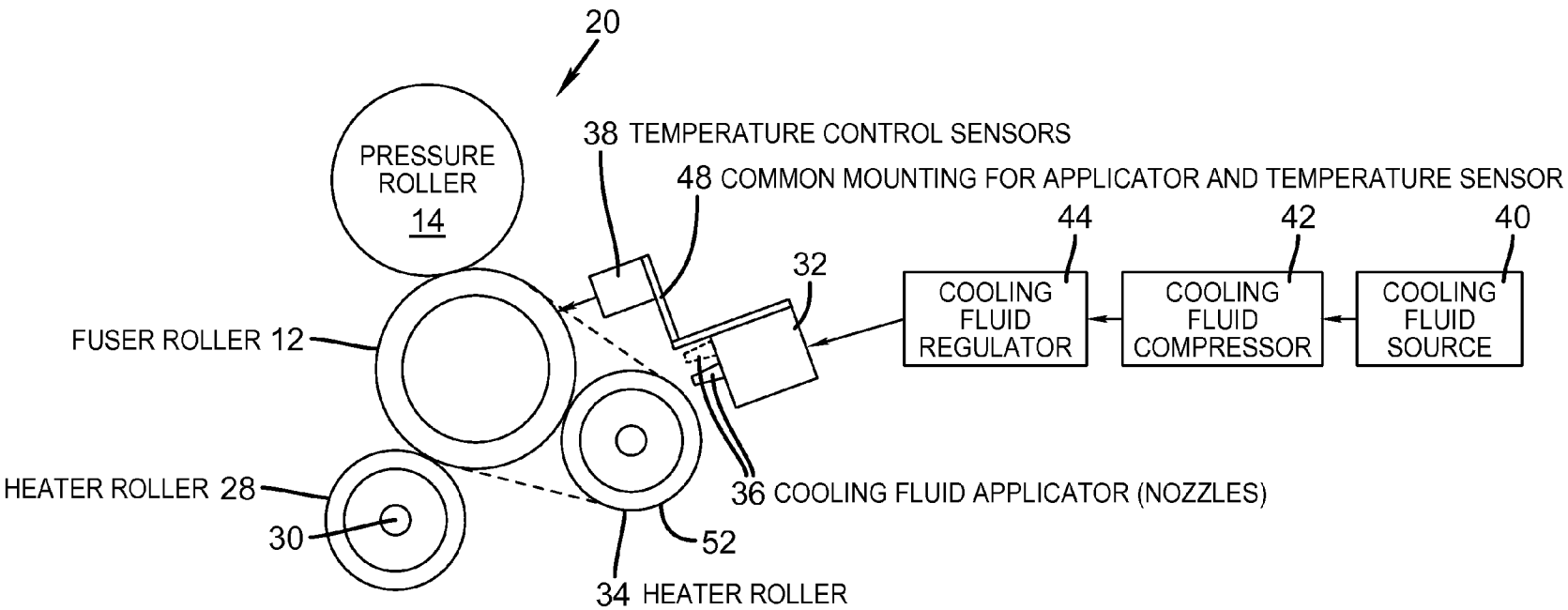
FIG. 3 is a schematic of a temperature controller fuser for the inventive printing process and system

The roller fuser assembly 10 includes a fuser roller 12, a pressure roller 14, and other necessary sub-systems and components (not shown). The roller 12 (or both rollers 12 and 14) is heated internally (for example by lamps 16, 18) to preset temperatures and is cooled using a cooling system 20. The fuser roller can be heated in a variety of means including internally and/or externally or even with a non-contact heater, such as an infrared or ultraviolet source of heat. One means of externally heating the fuser roller includes the heating external heat rollers (as shown in FIG. 3), such as to pre-set temperatures. The present invention is used to control a fusing temperatures and temperature distribution along the length of the fusing roller.

When fusing prints on receiver members S, the rollers 12 and 14 are pressed together to form a nip, and rotation of the rollers drive prints through the nip. In the nip, heat energy stored in the fuser roller 12 is transferred to the prints, and heats up and melts the toner image carried by the receiver member so that the toner is fixed on the receiver member under controlled temperature and pressure conditions.

The fuser roller, as well as the external heater rollers, has end portions and a middle portion. The fuser roller fixes the image on the receiver. The optional one or more external heater rollers are in contact with the fuser roller. In one embodiment one or more nozzles are directed at the fuser roller and/or the external heater rollers, to direct pressurized fluid toward the fuser roller based on fusing parameters. The system also has a controller to control at least a fuser run condition and a fuser idle condition to control the amount of fluid directed through the nozzles to cool the ends of external heater roller(s) relative to the middle portion starting and ending at predetermined times during the fuser run condition as will be discussed in more details below.

In one example if the air flow is initiated at the beginning of a print run in sufficient quantities of cooling air it reduces the temperature increase at the ends of the fuser roller during a print run, and eliminates image defects, even at conditions that generated substantial image defects before addition of the cooling air. The controlled fuser system has to regulate the air temperatures, flow rate, flow pressure and/or a nozzle location since these fusing parameters all effect the cooling rate and final temperature of the fusing roller. For example, the amount and temperature of cooling air that is directed at the heater rollers is at a different temperature since the temperature of the external heater rollers is much higher than that of the fuser roller, and thus it is necessary to remove more heat with a given amount of cooling air at a given temperature, compared to directing the air at the fuser roller.

The controlled fusing system has two sets of air (or "cooling fluid") applicators, with a temperature sensor mounted in conjunction with one of the applicators, directed at opposite ends of at least one roller of an externally heated fuser. Note that a sensor can be located on a fuser roll and/or the heater roller but to measure results mount the sensor on the fuser roller. In one type of electrophotographic printer with center paper registration, the two cooling fluid applicators move equally in opposite directions to adjust to different substrate sizes, as determined by a paper supply or sensor in the paper path. In another type of electrophotographic printer with edge paper registration, only one cooling fluid applicator would be required. Cooling fluid (most practically air) flows to the applicators is controlled by a regulator that is controlled by the temperature sensor. In one embodiment the cooling fluid is supplied and is equally split between the two applicators by conventional means.

The configuration of the fuser roller 12 can greatly affect the receiver member release characteristics and heat transfer of the fuser. Generally the fuser roller 12 has a metal core 22, a base cushion 24, and a thin release topcoat 26. A thicker base cushion makes release geometry in the nip area more favorable for the receiver member to be released from the fuser roller 12, but makes the heat more difficult to transfer from the core 22 to the outer surface of the topcoat 26.

In another embodiment of the fuser as shown in FIG. 3, including the externally heated fuser roller 12 the fuser is heated by one or more heat rollers 28. This can be in addition to internal heating or separate from any other heat source.

This embodiment helps to preserve the favorable release geometry and improve the heat transfer characteristics, and may have one or more heating lamps 30 inside the heater rollers. The external heating rollers 28 can be metal and thus have high thermal conductivity and can transfer higher amount of heat than other external heating methodologies, such as radiation heating. They are also simple, less expensive, and present less potential fire hazards. However, since the external heating rollers 28 usually have small diameter, it is difficult to provide a large nip between an external heating roller and a fuser roller. This limits the heat transfer rate between an external heating roller 28 and a fuser roller 12. Furthermore, a high force between the external heating roller 28 and the fuser roller 12 may cause wear and damage to the fuser roller topcoat 26. The system is controlled relative to one or more fusing, fuser related parameter that is related to one or more of a print run and printer idle condition, an image formation parameter, a gloss-related parameter, a receiver property or other printing related conditions.

FIG. 3 shows a block diagram of one embodiment of the externally heated fuser with the cooling system 10, without supporting apparatus such as the oiler, skives and web cleaner. These are further described in U.S. Pat. Nos. 5,406,362; 6,289,185; 7,194,233, and 7,054,592, which are incorporated by reference. In one embodiment, the two cooling fluid applicators 32 are directed at the heater roller 34 on one side. There could be additional nozzles to direct air from the same side or the opposite such as directed at heater roller 28 shown on the left. A temperature sensor 38 is mounted in conjunction with one of the cooling fluid applicator nozzles 36. A cooling fluid supply 40, compressor 42 and regulator 44 are also shown. The regulator 44 is actuated according to the fuser roller temperature sensor 38 results and is mounted on a common mounting 48 in conjunction with one of the cooling fluid applicators 42. The regulator 44 enables increased air flow if the fuser roller (or fuser) temperature rises at the location of the cooling fluid applicator 42 according to results from the temperature control sensor 38. The nozzles release a specific temperature, volume, and pressure of air that is controlled by a cooling system controller 50. This controller is in communication with one or more of the fuser, fuser roller, external rollers, receiver, and various components related to image formation. This allows detection of temperatures and receiver type as well as other factors that influence images. In this embodiment, cooling fluid flow would be split equally between the two applicator nozzles at the front and rear, the two ends, of the heater roller(s).

Figure 4:
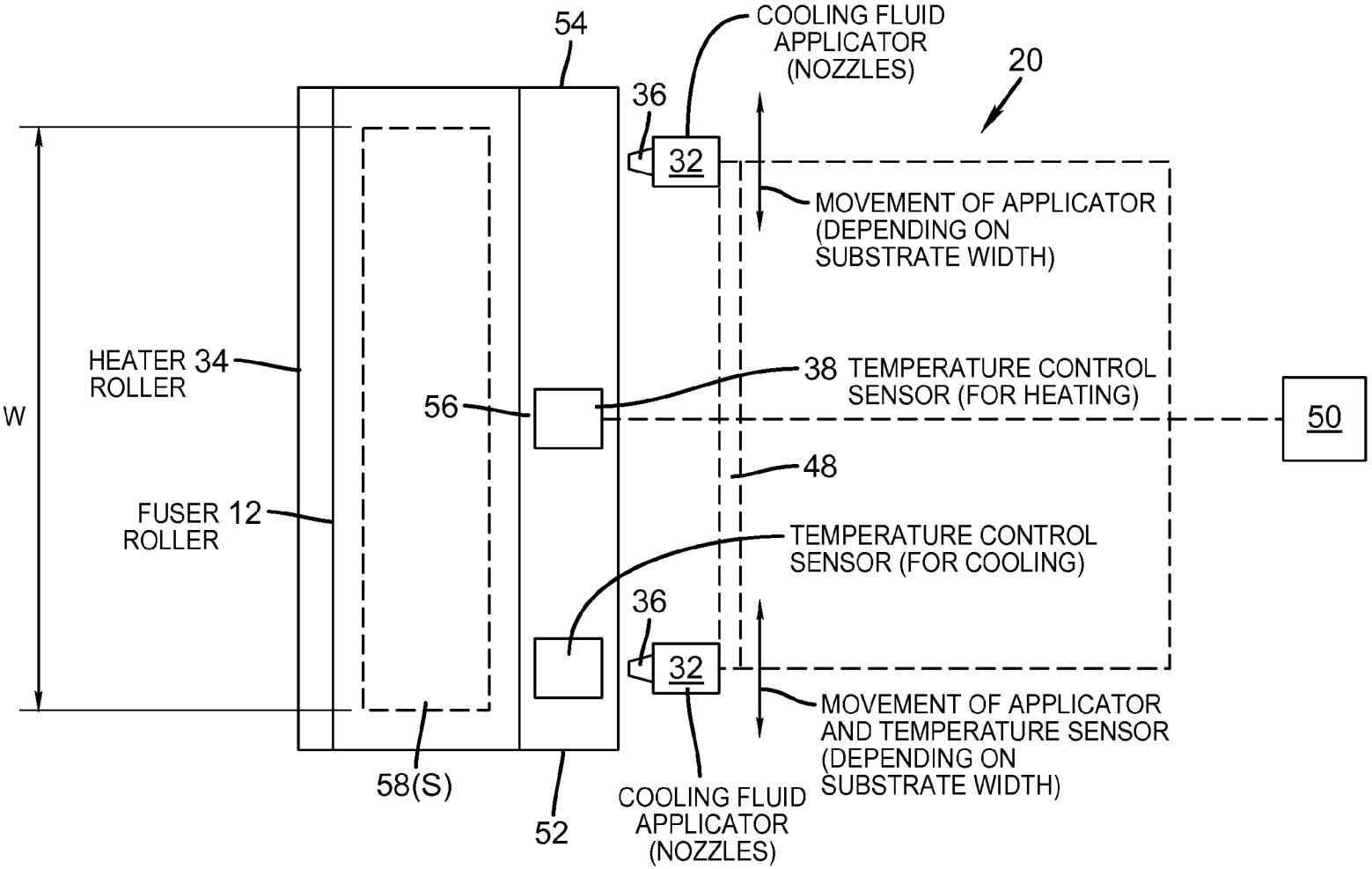
FIG. 4 presents a schematic diagram of details of the system in accordance with the present invention.

In the embodiment show in FIG. 4, the cooling system 20 shows a separate cooling device 50 for cooling the end portions 52, 54, such that the cooling device 20 can cool either the middle portion 56 and/or the end portions 52, 54. To more effectively simulate the run condition, according to an aspect of the invention, the length of the middle portion 56 is related to the width of the receiving sheet 58. For example, it may be approximately equal to, less than, or greater than the width (w) of the receiving sheet, the ideal relationship being determined empirically and/or stored in a table. In one embodiment, the cooling device 20 is adjustable such that as the receiver sheet 58 width (w) changes, the cooling device 20 adjusts to cool the corresponding fuser middle portion 56. Thus, for 11 inch paper, the middle portion would equal 11 inches, and for 14 inch paper, the middle portion would be 14 inches. This adjustment could be done on the cooling device 20 for example by having various ports available for fluid flow, and closing or opening these port according to the width needing cooling.

The adjustment of the cooling location, in one example, is made for the various widths of the paper by moving the two nozzles so that the air impinges on the roller. The fluid flow rate would preferably be kept constant. However, if desired, the fluid flow rate could be adjusted for the varying roller lengths to be cooled by varying the pressure applied to the fluid in a predetermined relationship to the length of the roller to be cooled. If desired, the pressure can be proportional to the length of the roller to be cooled. This technique can be used to cool portions of either the fuser roller or the heater roller. Alternatively, the nozzles can also contain adjustable orifices to maintain a constant fluid flow per unit length of the portion of the roller to be cooled. Specifically, the area of the nozzle opened by the orifice should be proportional to the length of the portion of the roller to be cooled.

Cooling must be done from the minimum width specified in the disclosure and extend to at least one inch on either side of the size of the paper being fused. Thus, an 8½ by 11 inch sheet of paper would require that the roller be cooled from a distance of one inch inside the edge of the paper path to at least one inch beyond the edge of the paper path up to the extent of the roller.

One embodiment of the current invention allows the fuser roller to be heated to within 85% of a nominal running temperature. In one example the heater roller is also used to obtain the nominal operating temperatures, which is preset for the specific printing conditions, along the length of the fuser roller so that the fuser roller is heated to one or more temperatures such as approximately 85% of the nominal operation temperature.

FIG. 4 shows a block diagram top view of the Kodak Digimaster ® externally heated fuser with further components removed. The top view shows the movement of cooling fluid applicators in opposite directions, depending on substrate width. Wider substrates cause the applicators to move further towards the ends of the rollers while narrower substrates cause the applicators to move closer to the center of the rollers. The optimum distance between the cooling fluid applicators and the substrate edges is dependent upon several factors, such as the design configuration of the fuser and the fuser roller material, and can be anywhere between 0.5 inches inside to 1 inch outside the paper edges, within the scope of the invention.

The fuser roller temperature control sensor is also shown in the top view. This sensor controls the fuser roller temperature at the center of the fuser roller by varying the duty cycle of the lamps (not shown) located inside the heater rollers, as is common in the art. The reason for showing both temperature control sensors is to differentiate between their functions. The existing sensor in the center of the fuser roller is used for heating the entire fuser roller while the new temperature control sensor near one edge of the fuser roller is used for cooling the ends of the fuser roller.

The temperature control sensor for cooling is shown in the exact same position (along the axis of the fuser roller) as the cooling fluid applicator in this illustration. The temperature control sensor for cooling could also be biased with respect to the cooling fluid applicator within the scope of the invention, but must move axially in conjunction with the cooling fluid applicator.

The invention has been described in detail with particular reference to certain preferred embodiments thereof, but it will be understood that variations and modifications can be effected within the spirit and scope of the invention.

What is claimed is:

1. An electrophotographic apparatus comprising:

a. a device for creating an electrostatic latent image;

b. a one or more development stations capable of converting the electrostatic latent image into an image on a receiver;

c. a controlled fuser having a fuser roller and one or more external heater rollers, said external heater rollers contacting the controlled fuser to heat a fuser roller having:

i. two end portions and a middle portion for heating the fuser roller;

ii. one or more nozzles directed at the external heater rollers, to direct pressurized fluid toward the one or more external heating rollers based on one or more fuser parameters; and d. a controller to control at least a printer and run condition and a printer idle condition based on one or more fuser parameters.

2. The apparatus of claim 1 wherein said controller controls an amount of said cooled pressurized fluid directed through the nozzles to cool the ends of external heater roller(s) relative to the middle portion starting and ending at predetermined times during the fuser run condition.

3. An apparatus of claim 1 wherein said cooled pressurized fluid is an air flow and whereby the controller determines the temperature of the center of the fuser roller and the ends of the fuser roller by controlling the air flow to cool the heater roller to adjust the temperature of the fuser roller.

4. An apparatus of claim 3 whereby the ends of the heater roller are cooled to control the temperature at the ends of the fuser roller.

5. The apparatus of claim 1 where by the fuser roller is heated with to within 85% of the nominal running temperatures and the heater roller is used to obtain a nominal operating temperature along the length of the fuser roller.

6. The apparatus of claim 1 wherein said cooled pressurized fluid is directed at one or more positions on the one or more external heater roller end portions positioned beyond the width of the receiving sheet width.

7. The apparatus of claim 1 wherein said external heater roller end portions are cooled at a location at the width of the receiving sheet.

8. The apparatus of claim 1 wherein said external heater roller end portions are located within the width of the receiving sheet.

9. The apparatus of claim 1 wherein said controller adjusts said starting and ending times and amount of said cooled pressurized fluid according to at least one parameter.

10. The apparatus of claim 1 wherein said controller adjusts a pressure of said cooled pressurized fluid according to at least one parameter.

11. The apparatus of claim 1 wherein said nozzles are joined by a common mounting such that the nozzles move together.

12. The apparatus of claim 11 wherein said controller controls a traversing of both nozzles parallel to the longitudinal axis of one or more external heater rollers, in opposing directions keeping the longitudinal positions of the nozzles at a predetermined relationship.

13. An electrographic printing method of producing prints using a fuser having a cooling system for fixing toner images to a receiving sheet comprising:

a. forming an electrostatic latent image and depositing toner particles to render the electrostatic latent image visible;

b. transferring he toned image to a receiver;

c. fixing the toned image the fuser having a run condition and an idle condition, wherein the fuser has a fuser roller and one or more external heater rollers, said heater rollers having end portions and a middle portion; and d. using a fuser controller to control a pressurized fluid directed through one or more nozzles based on a fuser parameter e. traversing said two or more nozzles parallel to a longitudinal axis of one or more external heater rollers, in opposing directions and the flow of pressurized fluid in a predetermined relationship so that the amount of fluid directed through the nozzles is based on a receiver width.

14. The method of claim 13 wherein the fuser parameter is based on a width of a receiver.

15. The method of claim 13 wherein when said one or more external heater rollers contact the fuser roller, said two nozzles direct said cooled pressurized fluid at the outer surfaces of both ends of the one or more external heater rollers.

16. The method of claim 14, further comprising controlling the amount of fluid directed through the nozzles based on receiving sheet width based on a predetermined relationship; to cool the ends of the one or more external heater roller relative to the middle portion starting and ending at a predetermined time during the fuser run condition to maintaining a more uniform temperature profile along a fuser roller axial length while printing.

17. The method of claim 16 further comprising controlling the pressurized fluid cool the one or most external heater roller relative to the middle portion starting and ending at predetermined time during the fuser run condition.

18. The method of claim 13 wherein said fuser parameter further comprising a receiver sheet weight, and adjusting said predetermined amount of fluid and a starting and ending time according to said receiver sheet weight.

19. The method of claim 18 further controlling based on at least one additional property and adjusting said predetermined starting and ending times and amount of fluid according to said at least one property.

20. The method of claim 13 wherein said cooling is accomplished by blowing compressed air onto the ends of the external heater roller(s).

21. The method of claim 13 wherein said cooling uses pressurized air flow based on the temperature of the center of the fuser roller and the ends of the fuser roller to adjust the temperature of the fuser roller.

22. The method of claim 21 said cooling further comprising cooling said ends of the heater roller to control the temperature at the ends of the fuser roller.

23. The method of claim 22 further comprising heating the fuser roller to within 85% of the nominal running temperatures using the heater roller to obtain a nominal operating temperature along the length of the fuser roller.

* * * * *